US007725952B1

(12) United States Patent
Wight

(10) Patent No.: US 7,725,952 B1
(45) Date of Patent: Jun. 1, 2010

(54) WEATHER GARMENT, PARTICULARLY FOR USE WITH FORMAL WEAR

(76) Inventor: Christina Wight, 927 Thompson St., Pittsboro, NC (US) 27312

( * ) Notice: Subject to any disclaimer, the term of this patent is extended or adjusted under 35 U.S.C. 154(b) by 0 days.

(21) Appl. No.: 12/016,468

(22) Filed: Jan. 18, 2008

(51) Int. Cl.
*A41D 13/012* (2006.01)
*A61F 5/02* (2006.01)

(52) U.S. Cl. ..... 2/46; 2/82; 2/93

(58) Field of Classification Search ..... 2/46, 2/51, 85, 93, 82
See application file for complete search history.

(56) References Cited

U.S. PATENT DOCUMENTS 2,752,603 A * 7/1956 Greene ..... 2/46
2,994,088 A * 8/1961 Marks ..... 2/47
3,323,136 A * 6/1967 James ..... 2/87
D453,607 S * 2/2002 Tracy ..... D2/826

* cited by examiner

*Primary Examiner*—Gloria Hale

(57) ABSTRACT

The present invention provides a protective weather garment. The protective weather garment may include an upper portion, a body portion, and an adjustable bottom portion. The adjustable bottom portion includes an adjusting member so that the bottom portion can be adjusted to fit to the dimensions of an under garment worm by a person. The adjusting member includes a flap having a flap width disposed about a periphery of the adjustable bottom portion and extending from the adjustable bottom portion. The adjusting member is configurable to adjust a diameter of the adjustable bottom portion formed by the flap such that the flap width is adjusted with the adjusting member.

7 Claims, 5 Drawing Sheets

WEATHER GARMENT, PARTICULARLY FOR USE WITH FORMAL WEAR

FIELD OF THE INVENTION

The present invention relates generally to protective outerwear and more particularly to a weather garment worn in conjunction with formal wear.

BACKGROUND OF THE INVENTION

People often use rain coats to protect themselves and their over garments from the inclement weather. Traditional rain coats are worn over outer garments and generally do not extend beyond the feet of the person wearing the rain coat. Such traditional rain coats do not offer adequate protection if the garments extend beyond the feet of the person. For example, a wedding dress may include a train which extends well beyond the feet of the person wearing the wedding dress. As a traditional rain coat does not extend beyond the feet of the person wearing the rain coat, the traditional rain coat may not offer adequate protection for the wedding dress.

In addition, traditional rain coats are effective at protecting garments having traditional cuts, such as tapered pants, dresses, or the like. These traditionally cut garments typically have a midsection portion with approximately the same outer dimensions as a bottom portion of the garment. However, these traditional rain coats may not adequately protect garments having unconventional dimensions.

Accordingly, a need exists for a weather garment which adequately covers a garment having unconventional dimensions. Moreover, the weather garment should be configured to allow viewing of the garment worn under the weather garment.

SUMMARY OF THE INVENTION

Embodiments of the present invention relate to a weather garment for formal wear, such as a wedding dress. The weather garment includes a hood and a body portion where the hood protects the head of a person wearing the weather garment. The body portion is configured to protect garments or clothes worn by the person. The body portion includes an upper portion and a bottom portion where the bottom portion may be wider than the upper portion. The bottom portion includes an adjustable bottom portion which allows for resizing of the bottom portion depending on the dimensions of the garment being worn underneath the weather garment.

The adjustable bottom portion may also include a flap which may be adjusted in order to protect a bottom portion of a garment worn by a person, which may extend beyond the person's feet, such as a train of a wedding dress for example. Thus, the adjustable bottom portion, along with the flap, protects the bottom portion of the person's clothing. The flap may include a tying member, which allows for adjustment of the flap in order to accommodate the portion of the person's clothing which extends beyond the person's feet.

Those skilled in the art will appreciate the scope of the present invention and realize additional aspects thereof after reading the following detailed description of the preferred embodiments in association with the accompanying drawing figures.

BRIEF DESCRIPTION OF THE DRAWING FIGURES

The accompanying drawing Figures incorporated in and forming a part of this specification illustrate several aspects of the invention, and together with the description serve to explain the principles of the invention.

DETAILED DESCRIPTION OF THE PREFERRED EMBODIMENTS

The embodiments set forth below represent the necessary information to enable those skilled in the art to practice the invention and illustrate the best mode of practicing the invention. Upon reading the following description in light of the accompanying drawing figures, those skilled in the art will understand the concepts of the invention and will recognize applications of these concepts not particularly addressed herein. It should be understood that these concepts and applications fall within the scope of the disclosure and the accompanying claims.

The present invention relates to a weather garment for formal wear, such as a wedding dress. The weather garment includes a hood and a body portion where the hood protects the head of a person wearing the weather garment. The body portion is configured to protect garments or clothes worn by the person. The body portion includes an upper portion and a bottom portion where the bottom portion may be wider than the upper portion. The bottom portion includes an adjustable bottom portion which allows for resizing of the bottom portion depending on the dimensions of the garment being worn underneath the weather garment.

The adjustable bottom portion may also include a flap which may be adjusted in order to protect a bottom portion of a garment worn by a person, which may extend beyond the person's feet, such as a train of a wedding dress for example. Thus, the adjustable bottom portion, along with the flap, protects the bottom portion of the person's clothing. The flap may include a tying member, which allows for adjustment of the flap in order to accommodate the portion of the person's clothing which extends beyond the person's feet.

Figure 1:
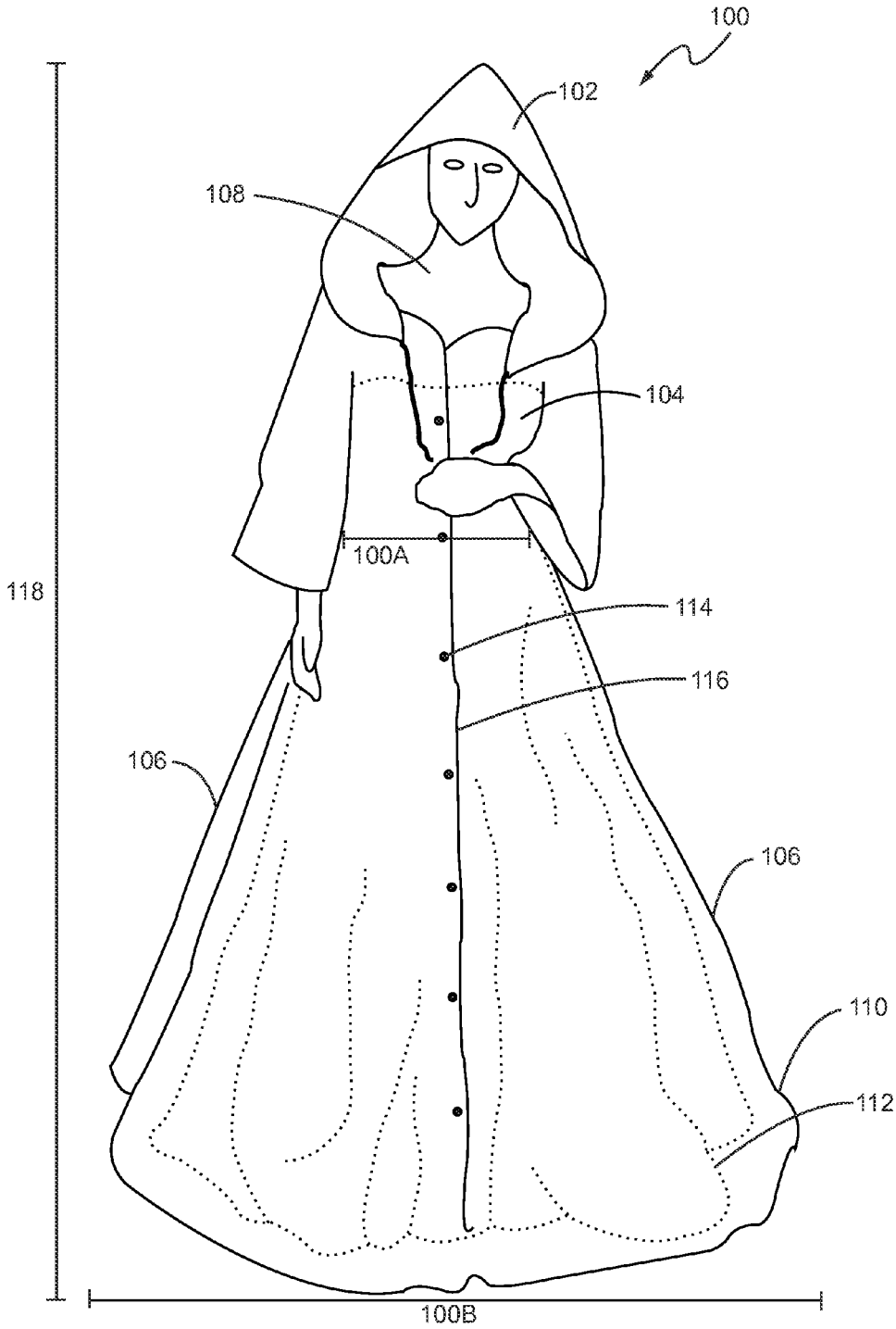
FIG. 1 is a schematic view of a weather garment in accordance with an embodiment of the present invention.

FIG. 1 illustrates a weather garment 100 in accordance with an embodiment of the present invention. The weather garment 100 includes a hood 102, an upper portion 104, and a body portion 106 extending from the upper portion 104. The hood 102 may be used to protect a person 108 wearing the weather garment 100. The upper portion 104 protects an upper portion of the person 108, and the body portion 106 protects a bottom portion of the person 108. The body portion 106 includes an adjustable bottom portion 110 extending therefrom, where the weather garment 100 may be used to protect a garment 112 worn by the person 108 under the weather garment 100. The adjustability of the adjustable bottom portion 110 allows a person to configure the weather garment 100 to the dimensions of the garment 112, whether they be traditional dimensions or not.

The weather garment 100 may also include fastening elements 114 disposed along a seam 116 of the weather garment 100. The fastening elements 114 may be any type of device which facilitates securing of the weather garment 100 over the garment 112. For example, the fastening elements 114 may include buttons, a zipper, where the zipper is disposed along an entire length of the seam 116, Velcro™, or any other type of fastener. The fastening elements 114 and the seam 116 allow the person 108 to place the weather garment 100 over the garment 112 while the person 108 is wearing the garment 112. In addition, the fastening elements 114 and the seam 116 allow for securing of the weather garment 100 over the garment 112 while the garment 112 is on the person 108.

The weather garment 100 has a total length 118 where the hood 102, the upper portion 104, the body portion 106, and the adjustable bottom portion 110 form the total length 118. An upper portion of the weather garment 100 has a width 100*a*, and a lower portion of the weather garment 100 has a width 100*b*. In one embodiment, as may be seen in FIG. 1, the width 100*b* is substantially larger than the width 100*a* such that the weather garment 100 has a configuration which widens from the top to the bottom in order to accommodate garments, such as the garment 112, having a configuration which widens from the top to the bottom, such as a wedding dress or the like. Alternatively, the width 100*a* may be substantially the same as the width 100*b*. Moreover, the width 100*a* may be substantially larger than the width 100*b*. As may be seen with reference to FIG. 1, the length 118 and the widths 100*a* and 100*b* of the weather garment 100 are such that the garment 112 is fully enclosed by the weather garment 100. Moreover, the adjustable bottom portion 110 of the weather garment 100 is configured to fully enclose a bottom portion of the garment 112, as more clearly shown with reference to FIG. 2.

Figure 2:
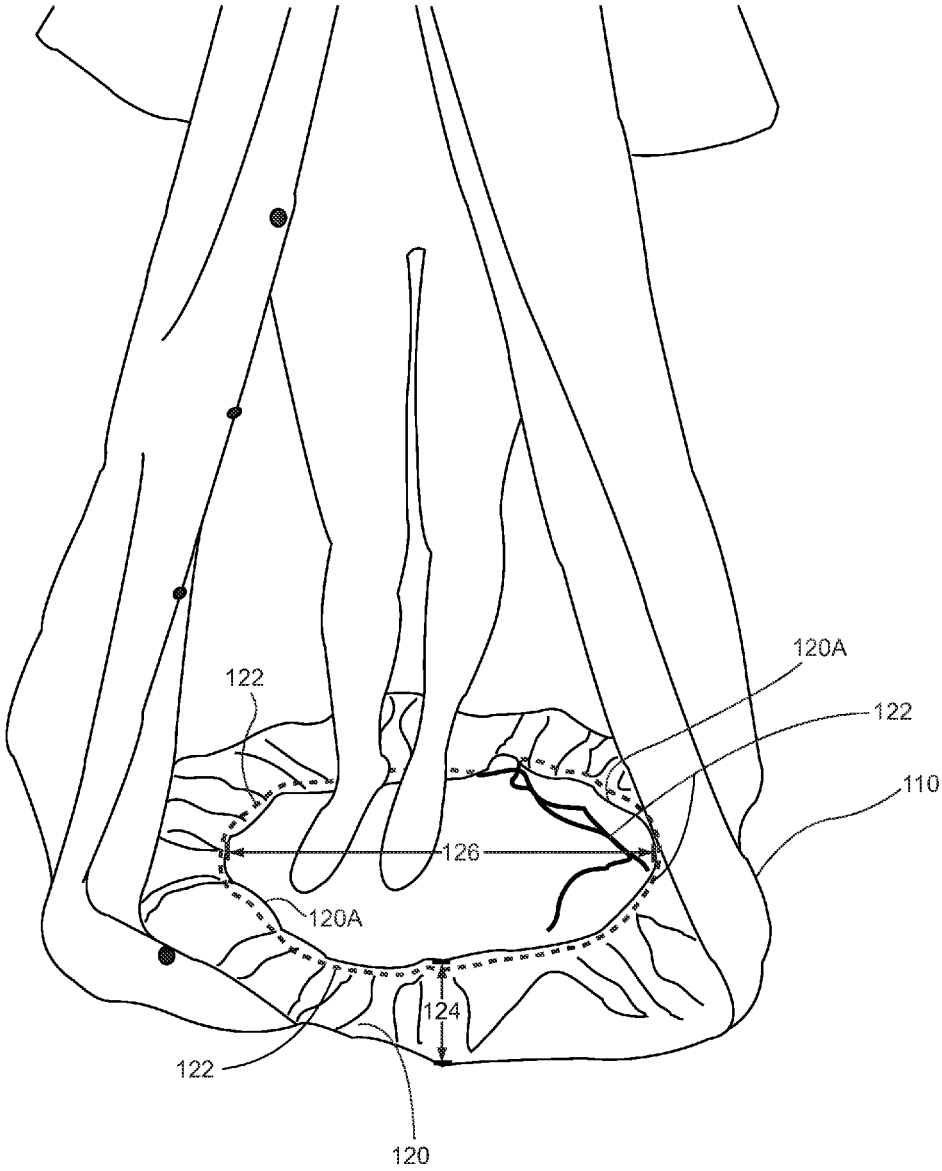
FIG. 2 illustrates an adjustable bottom portion of the weather garment shown in FIG. 1, in accordance with an embodiment of the present invention.

With reference to FIG. 2, the adjustable bottom portion 110 may include a flap 120 having an adjusting member 122. The adjusting member 122 may be disposed about an inner periphery 120*a* of the flap 120. As may be seen with reference to FIG. 2, the flap 120 is disposed about, and extends from, an inner periphery of the adjustable bottom portion 110 such that the flap has a flap width 124. In addition, the flap width 124 forms an inner diameter 126 of the adjustable bottom portion 110. The adjusting member 122 may be a drawstring, elastic member, or the like, which may be used to adjust the inner diameter 126 and the flap width 124 of the flap 120.

Figure 3:
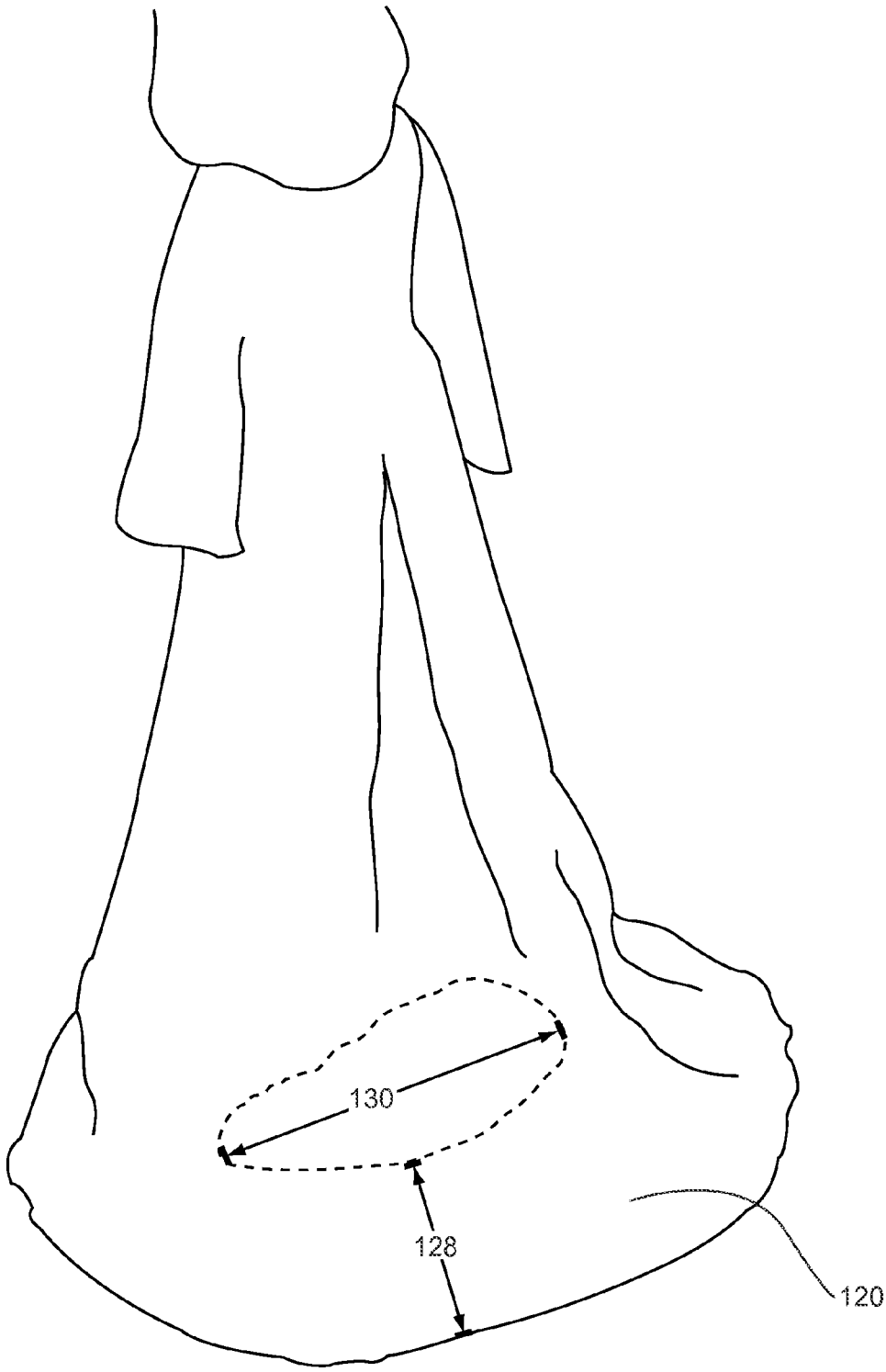
FIG. 3 illustrates an alternative view of the adjustable bottom portion shown with reference to FIG. 2, in accordance with an embodiment of the present invention.

As shown in FIG. 3, the adjusting member 122 (not shown) may be adjusted such that the flap 120 has a flap width 128 where, in this embodiment, the flap width 124 is substantially smaller than the flap width 128. Furthermore, the adjusting member 122 may be adjusted such that the flap 120 has an inner diameter 130, which, in this embodiment, is smaller than the inner diameter 126. Alternatively, the adjusting member 122 may be adjusted such that the flap width 128 may be smaller than the flap width 124 and the inner diameter 130 is larger than the inner diameter 126. In accordance with embodiments of the present invention, the width of the flap 120 may be adjusted according to the dimensions of a garment, such as the garment 112, which is worn under the weather garment 100. Moreover, the width of the flap 120 may be adjusted according to the dimensions of a garment worn underneath the weather garment 100, as shown in FIGS. 4A and 4B.

Figures 4A, 4B:
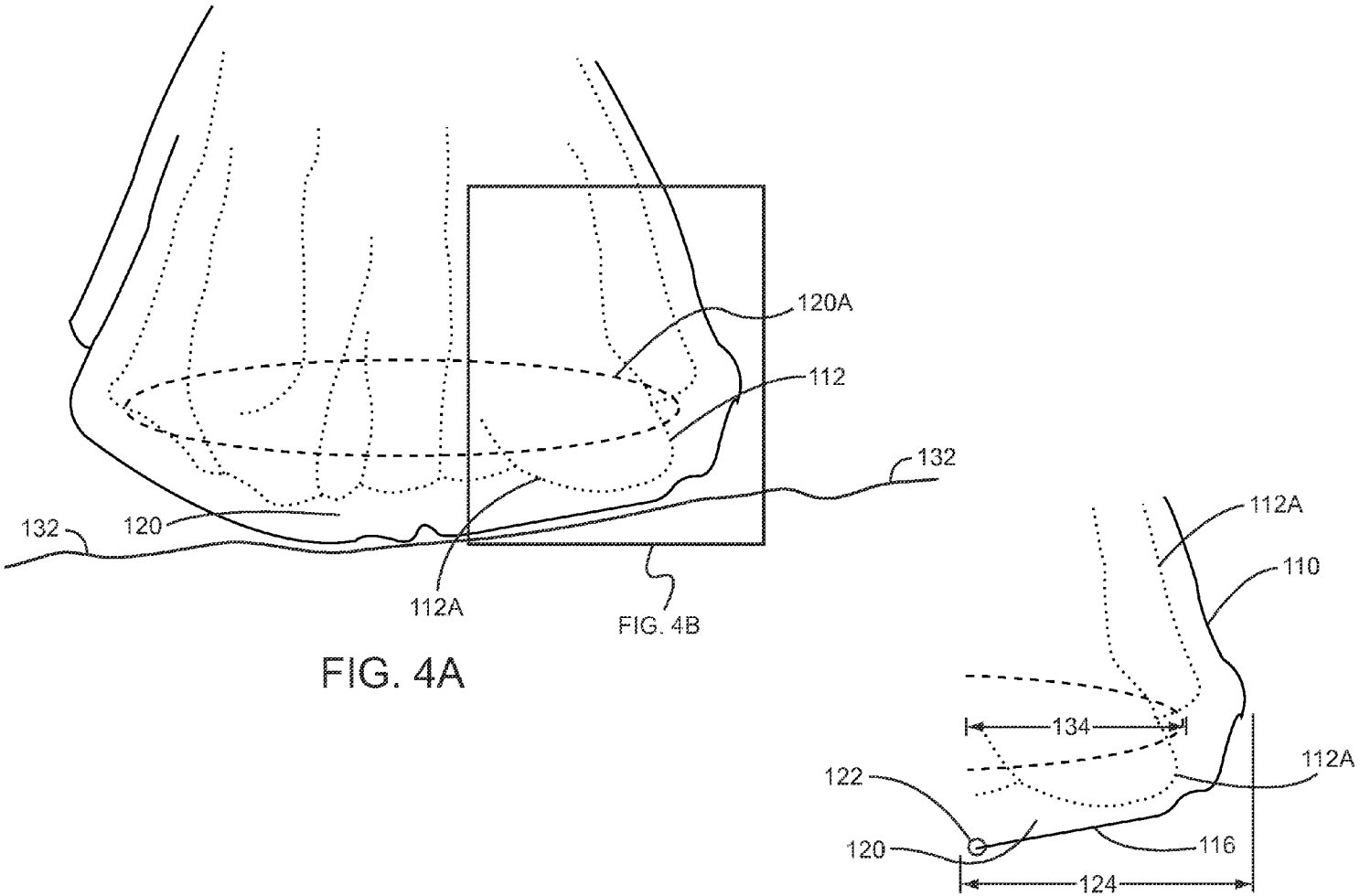
FIGS. 4A and 4B illustrate an embodiment of the present invention where the adjustable bottom portion shown in FIG. 2 encloses a bottom portion of a garment.

When the weather garment 100 is worn over the garment 112, the flap 120 may enclose a bottom portion 112*a* of the garment 112, as shown in FIGS. 4A and 4B, where FIG. 4B is a cross-sectional view of FIG. 4A. More specifically, as illustrated in FIG. 4A, the bottom portion 112*a* of the garment 112 sits on the flap 120 such that the flap 120 isolates the bottom portion 112*a* of the garment 112 and prevents contact between the bottom portion 112*a* and a surface 132, such as the ground. Accordingly, if the garment 112 is a wedding dress where the bottom portion 112*a* is a train of the wedding dress, the train may be protected from the surface 132.

Moreover, in the embodiment shown in FIG. 4B, the bottom portion 112*a* of the garment 112 has a width 134. As previously mentioned, the flap width 124 of the flap 120 may be adjusted. Thus, in accordance with the present invention, if the width 134 of the bottom portion 112*a* is substantially larger, i.e., in an embodiment where the garment 112 is a wedding dress and the wedding dress has an extremely long train, the flap 120 may be adjusted with the adjusting member 122 such that the flap 120 has the flap width 128, in order to accommodate the increased size of the bottom portion 112*a*. Alternatively, if the bottom portion 112*a* of the garment 112 is substantially smaller, the flap 120 may be adjusted to have the flap width 124.

The weather garment 100 may be formed from any material. In the disclosed embodiments, the weather garment 100 is formed from a transparent material, such as clear plastic or the like, in order to facilitate viewing of the garment 112 when the weather garment 100 is worn over the garment 112. Thus, in an embodiment where the weather garment 100 is formed from a transparent material, the garment 112, such as a wedding dress, may be viewed by others. This may be particularly useful if viewing by others is desired without having to remove the weather garment 100.

Figure 5:
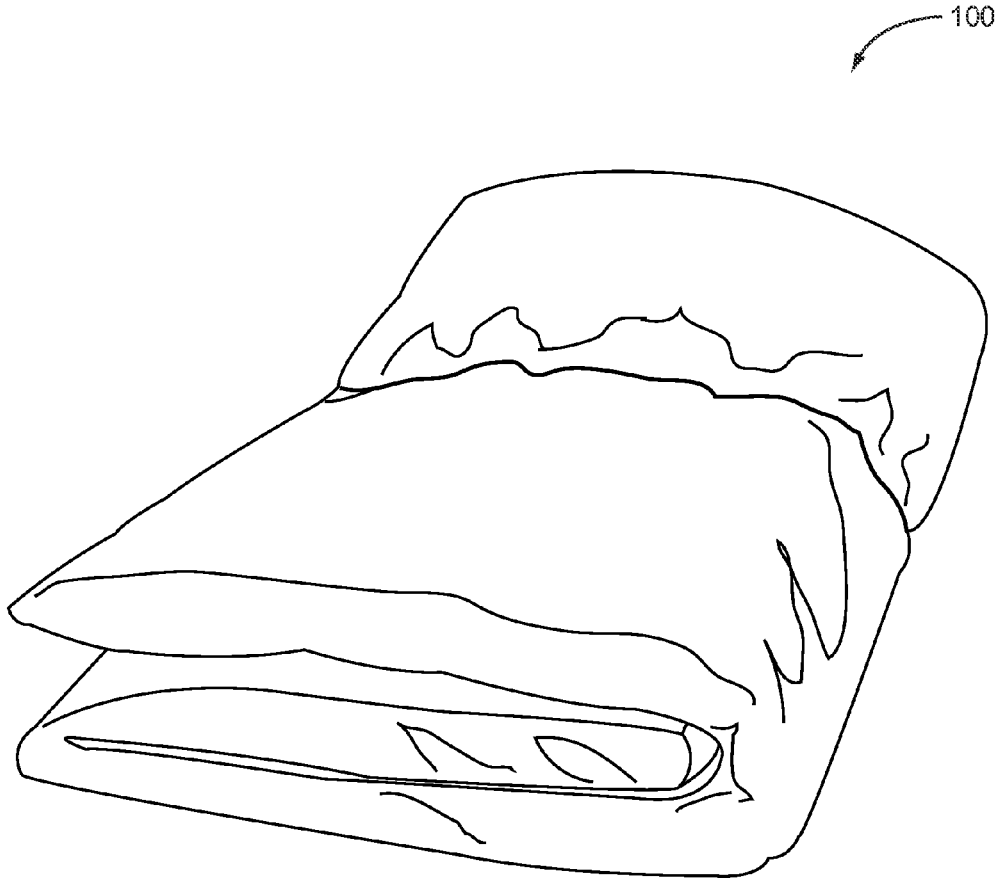
FIG. 5 illustrates an embodiment of the present invention illustrating a perspective view of a weather garment in a folded configuration.

FIG. 5 illustrates the weather garment 100 in a folded position in accordance with another embodiment of the present invention. More specifically, when the weather garment 100 is not in use, the weather garment 100 may have the folded configuration shown with respect to FIG. 5 in order to facilitate transport of the weather garment 100.

Those skilled in the art will recognize improvements and modifications to the preferred embodiments of the present invention. The present invention is not limited to a weather garment used with formal wear. The weather garment can be used to protect any type of under garments desired. Further, the present invention is not limited to the weather garment being formed out of any particular material. All such improvements and modifications are considered within the scope of the concepts disclosed herein and the claims that follow.

What is claimed is:

1. A formal garment protector garment for covering a formal dress, long dress or gown from inclement weather or other environmental elements that would stain or soil the formal dress, long dress or gown in use comprising:

An upper torso body portion having a hood extending upwardly therefrom and left and right sleeves extending outwardly therefrom;

a lower torso body portion having an upper end extending downwardly from said upper torso body portion;

said lower body portion having a lower end periphery;

said lower body portion lower end periphery includes an adjustable bottom portion attached about said lower end periphery;

said adjustable bottom portion includes a flap having a first end peripherally attached to said lower end periphery and an opposite second end periphery wherein said flap area between said first and opposite peripheral ends equals a flap width;

an adjusting member is attached at said opposite peripheral end and is configured to adjust a diameter of the adjustable bottom portion and said flap width;

said flap width is configured to extend under and upwardly from said long, formal gown hem to protect said gowns lower hem edge;

said upper and lower torso body portions further including front and rear panels;

said front panel having a central opening extending an entire length of said upper and lower torso body portions from a neck opening to said lower end periphery;

a closure means located on said central opening; and said hood protecting a wearer's head and said upper and lower torso body portion protecting an entire surface of said formal, long gown or dress from inclement weather or other environmental staining and wherein said garment protector is formed of a protective material.

2. A formal garment protector garment as claimed in claim 1, wherein said formal gown protector garment material is formed of a transparent material.

3. A formal garment protector garment as claimed in claim 1, wherein the adjusting member is a drawstring attached about the periphery of the adjustable bottom portion.

4. A formal garment protector garment as claimed in claim 1, wherein the flap width is sized to hold a formal dress or long gown train.

5. A formal garment protector garment as claimed in claim 1, wherein the upper torso body portion has a width that is larger than the lower torso body width.

6. A formal garment protector garment as claimed in claim 2 wherein said transparent material is a plastic material.

7. A formal garment protector garment as claimed in claim 2, wherein the upper torso body portion has a width that is larger than the lower torso body portion width.

* * * * *